US008442245B2

(12) United States Patent
Wurzbacher et al.

(10) Patent No.: US 8,442,245 B2
(45) Date of Patent: May 14, 2013

(54) HEARING DEVICE WITH AUTOMATIC ALGORITHM SWITCHING

(75) Inventors: Tobias Wurzbacher, Fürth (DE); Matthias Fröhlich, Jiangsu (CN)

(73) Assignee: Siemens Medical Instruments Pte. Ltd., Singapore (SG)

( * ) Notice: Subject to any disclaimer, the term of this patent is extended or adjusted under 35 U.S.C. 154(b) by 731 days.

(21) Appl. No.: 12/644,422

(22) Filed: Dec. 22, 2009

(65) Prior Publication Data

US 2010/0189292 A1 Jul. 29, 2010

(30) Foreign Application Priority Data

Dec. 22, 2008 (DE) ..... 10 2008 064 430

(51) Int. Cl.
*H04R 25/00* (2006.01)

(52) U.S. Cl.
USPC ..... 381/313; 381/60; 381/92

(58) Field of Classification Search ..... 381/58, 381/60, 312, 313, 314, 79, 80, 81, 91, 92, 381/122, 123
See application file for complete search history.

(56) References Cited

U.S. PATENT DOCUMENTS

| | | | | |
|---|---|---|---|---|
| 6,879,692 | B2 * | 4/2005 | Nielsen et al. | 381/60 |
| 7,242,778 | B2 * | 7/2007 | Csermak et al. | 381/60 |
| 2004/0202333 | A1 | 10/2004 | Csermak et al. | |
| 2009/0296946 | A1 * | 12/2009 | Zhang | 381/58 |
| 2009/0304187 | A1 | 12/2009 | Dittberner | |

FOREIGN PATENT DOCUMENTS

| | | | |
|---|---|---|---|
| CN | 1528279 | A | 9/2004 |
| CN | 1173989 | C | 11/2004 |
| WO | 2007098768 | A1 | 9/2007 |

* cited by examiner

*Primary Examiner* — Huyen D Le
(74) *Attorney, Agent, or Firm* — Laurence A. Greenberg; Werner H. Sterner; Ralph E. Locher

(57) ABSTRACT

A hearing device with a plurality of microphones is intended to be able to be continued to be operated sensibly, even if a microphone fails. Therefore, a hearing device, and in particular a hearing aid, is proposed which provides a decision unit for deciding whether one of the microphones is defective, and a signal processing unit for processing the signals from the microphones using a plurality of processing algorithms. The signal processing unit switches from a first one of the processing algorithms to a second one of the processing algorithms if a decision is made in the decision unit that one of the microphones is defective. In particular, if a microphone fails, automatic switching from directional microphone operation into omnidirectional operation is for example made possible.

10 Claims, 1 Drawing Sheet

HEARING DEVICE WITH AUTOMATIC ALGORITHM SWITCHING

CROSS-REFERENCE TO RELATED APPLICATION

This application claims the priority, under 35 U.S.C. §119, of German application DE 10 2008 064 430.7, filed Dec. 22, 2008; the prior application is herewith incorporated by reference in its entirety.

BACKGROUND OF THE INVENTION

Field of the Invention

The present invention relates to a hearing device with a plurality of microphones, a decision unit for deciding whether one of the microphones is defective, and a signal processing unit for processing the signals from the microphones using a plurality of processing algorithms. The term "hearing device" in this case is understood to mean any portable sound-emitting equipment in/on the ear or on the head, in particular a hearing aid, a headset, earphones or the like.

Hearing aids are portable hearing devices used to support the hard of hearing. In order to make concessions for the numerous individual requirements, different types of hearing aids are provided, e.g. behind the ear (BTE) hearing aids, hearing aids with an external earpiece (receiver in the canal (RIC)) and in the ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case the damaged sense of hearing is stimulated either mechanically or electrically.

In principle, the main components of a hearing aid are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction earpiece. The amplifier is usually integrated into a signal processing unit. This basic design is illustrated in FIG. 1 using the example of a behind the ear hearing aid. One or more microphones 2 for recording the sound from the surroundings are installed in a hearing aid housing 1 to be worn behind the ear. A signal processing unit 3, likewise integrated in the hearing aid housing 1, processes the microphone signals and amplifies them. The output signal from the signal processing unit 3 is transferred to a loudspeaker or earpiece 4 which emits an acoustic signal. If necessary, the sound is transferred to the eardrum of the equipment wearer using a sound tube which is fixed in the auditory canal with an ear mold. A battery 5 likewise integrated into the hearing aid housing 1 supplies the hearing aid and in particular the signal processing unit 3 with power.

Modern hearing aids often contain two or more microphones and so the signal processing can evaluate two or more microphone signals. If one of the required microphone signals fails, the corresponding hearing aid algorithms are operated in a signal constellation which is not envisaged in the design of the signal processing. This affects a drop in performance of the noise reduction and reduces the sound quality. Additionally, the clarity of speech is reduced in the surrounding noise.

There are different ways in which the microphone signal can fail. It can either fail permanently as a result of a mechanical defect, a creeping deterioration as a result of the microphones ageing; or it can be only temporary as a result of a dirtied microphone opening or the hearing aid being partly covered, for example by hair, a hat or a scarf.

In this context, a self-check mode of a hearing aid has been disclosed by the Starkey Company, in which the hearing aid wearer can, by a mechanical action, place the hearing aid into a state in which the hearing aid checks itself by a performance test. To this end, a stimulus is emitted by the hearing aid in order to test, inter alia, the hearing aid microphone and the loudspeaker. The self-check has to be initiated by user action and there is no continuous monitoring during the operation of the hearing aid.

Furthermore, U.S. patent disclosure No. 2004/0202333 A1 discloses a hearing aid with self-diagnostics. A detection circuit is used to this end in order to monitor the performance status of at least one transducer by measuring the output energy level of the transducer and comparing it to a predetermined threshold level. The detection circuit generates an error message if the measured output energy level drops below the threshold level.

SUMMARY OF THE INVENTION

It is accordingly an object of the invention to provide a hearing device with an automatic algorithm switching which overcomes the above-mentioned disadvantages of the prior art devices of this general type. The hearing aid of the present invention functions in an improved fashion, at least temporarily, if one of a plurality of microphones partly or completely fails.

With the foregoing and other objects in view there is provided, in accordance with the invention a hearing device. The hearing device has a plurality of microphones, a decision unit connected to the microphones for deciding whether one of the microphones is defective, and a signal processing unit connected to the microphones for processing microphone signals from the microphones using a plurality of processing algorithms. The signal processing unit automatically switches from a first one of the processing algorithms to a second one of the processing algorithms if a decision is made in the decision unit that one of the microphones is defective According to the invention, the object is achieved by a hearing device with a plurality of microphones, a decision unit for deciding whether one of the microphones is defective, and a signal processing unit for processing the signals from the microphones using a plurality of processing algorithms. The signal processing unit automatically switches from a first one of the processing algorithms to a second one of the processing algorithms if a decision is made in the decision unit that one of the microphones is defective.

This advantageously affords the possibility of, in this way, continuing to operate the hearing device in a defined mode if a microphone fails. Such an emergency program will generally supply better sound quality of the hearing device than undefined signal processing. In this context, a "defective microphone" is also understood to mean a microphone which is covered by, for example, hair, headwear or dirt.

Preferably, the first signal processing algorithm is configured for multichannel processing and the second signal processing algorithm is configured for single-channel processing, and the signal processing unit switches from the multichannel processing algorithm to the single-channel processing algorithm if one of the microphones is defective. This can prevent an undefined channel signal from contributing to the output signal.

In particular, the signal processing unit can be configured for deactivating a multichannel processing algorithm if one of the microphones is defective. The hearing device then no longer provides multichannel processing if the hearing situation would possibly allow or require this.

In a further embodiment, the decision unit can have a level meter which measures the levels of the microphone signals in order to derive a decision therefrom. A prediction method can additionally be used for a robust decision: one of the microphone signals is estimated by using the other signal. If the time and/or spectral distribution of the prediction coefficients differ too strongly from the expected ones, a microphone has failed. The combination of a level meter and a prediction analysis allows relatively reliable conclusions to be drawn in respect of a microphone failing.

One of the processing algorithms can implement a directional microphone mode and another algorithm can implement an omnidirectional mode, the decision unit switching into the omnidirectional mode if one of the microphones is defective. Therefore, the directional microphony is only utilized if at least two sensibly evaluable microphone signals are actually present.

Furthermore, the hearing device according to the invention can have a storage unit by which a decision of the decision unit can be logged together with time information. By way of example, as a result of this, an audiologist can subsequently understand when and how often (loose connection) a microphone has failed.

Moreover, the second processing algorithm, to which a switch is made starting from the first processing algorithm if a microphone is defective, can explicitly not be matched to the first processing algorithm. If the two processing algorithms are completely independent of one another, a switching of the hearing aid can generally also be heard by the user. As a result of this, the user can easily recognize when a microphone fails.

Moreover, the signal processing unit can automatically generate a warning signal to warn the user when the processing algorithms are switched automatically. Such a warning signal makes it even easier for the user to recognize that a microphone has failed.

In accordance with a further preferred embodiment, a spectral reference curve for one or more of the microphones for making a decision in respect of a defect can be stored in the decision unit. If, for example, an averaged signal spectrum is obtained by a microphone, this enables the spectral sensitivity of the microphone to be reliably monitored.

Furthermore, a loudness of a sound signal recorded by the microphone or microphones can be used as the basis for the decision by the decision unit. Using this, the decision unit can also make decisions based on psycho-acoustic variables, e.g. only performing a switch when the user is first actually able to notice a defect.

The decision unit or the decision algorithms (defect: yes/no/gradual) can be configured such that:

a) the performance status of the microphones is monitored during operation, and that they also
b) function in the charge mode in the charging station associated with the hearing device.

In this fashion, a performance check of the components (microphones, signal processing) can be performed automatically when the hearing device is placed into the charging station. This has a number of advantages:

a) there is regular testing at the end of the day;
b) the hearing device always sits in an unambiguous position in the charging station and permits more detailed grading or earlier recognition of a defect;
c) there is defined playback of test sounds, either by the loudspeaker of the hearing device or by a signal generator and loudspeaker in the charging station; and
d) the charging station completely encloses the hearing device and reduces interfering surrounding noise.

Other features which are considered as characteristic for the invention are set forth in the appended claims.

Although the invention is illustrated and described herein as embodied in a hearing device with an automatic algorithm switching, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiment described in more detail below constitutes a preferred embodiment of the present invention.

Figure 1:
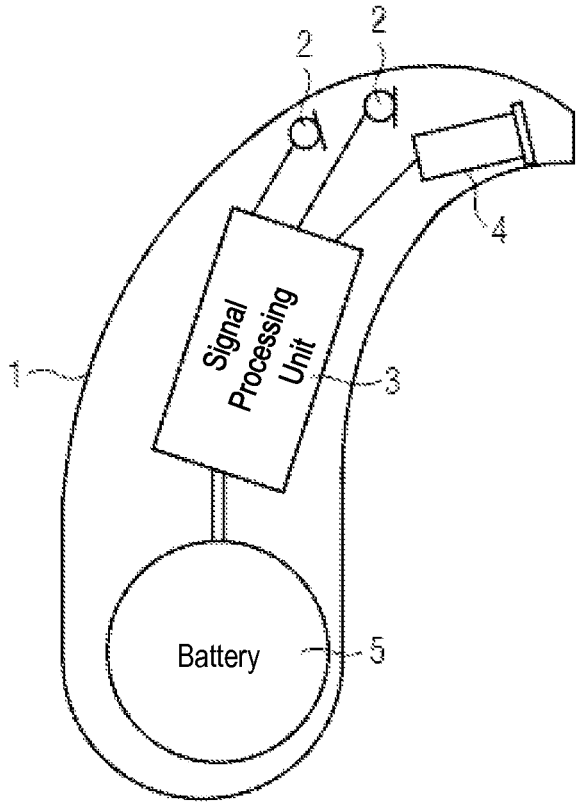
FIG. 1 PRIOR ART
FIG. 1 is a schematic design of a hearing aid in accordance with the prior art.
Figure 2:
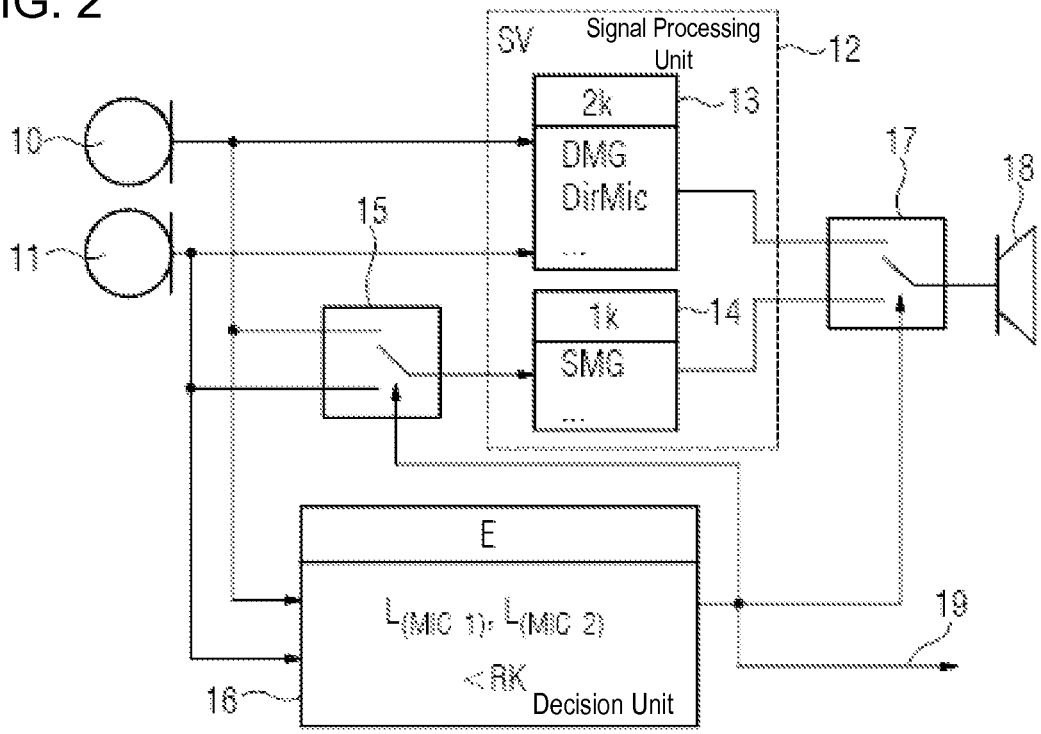
FIG. 2 is a block diagram of a hearing aid according to the invention.

Referring now to the figures of the drawing in detail and first, particularly, to FIG. 2 thereof, there is shown two microphones 10 and 11 at a signal input. The microphone signals are fed to a signal processing unit 12. The signal processing unit 12 has a multichannel processing algorithm 13 (a two-channel algorithm in this case). Here, the algorithm is suitable for directional microphony.

Moreover, the signal processing unit 12 has a single-channel processing algorithm 14. It is fed either by the microphone signal from one of the microphones 10 or by the microphone signal from the other microphone 11. A change-over switch 15 determines which microphone signal is fed on to the single-channel processing algorithm 14. The change-over switch 15 is actuated by a decision unit 16 which carries out a signal comparison or signal monitoring of the two microphone signals from the microphones 10 and 11. A decision unit 16 decides whether or not a microphone has failed. To this end, it measures the levels of the microphone signals in the present case and compares them to stored reference curves RK.

The decision unit 16 outputs which one of the two microphones 10, 11 is defective. The change-over switch 15 is actuated accordingly. However, the output signal from the decision unit 16 is also used for an additional change-over switch 17 arranged downstream of the signal processing unit 12. The output signals from the two-channel processing algorithm 13 and the single-channel processing algorithm 14 are applied to the input of the additional change-over switch 17. If the decision unit 16 has decided that one of the microphones 10, 11 has failed, the change-over switch 17 switches from the two-channel operation into the single-channel operation. Here, this means that it is no longer the output signal from the two-channel processing algorithm 13 which is fed on to the output-side loudspeaker 18, but the output signal from the single-channel processing algorithm 14. If need be, the output signal from the decision unit 16 can, in addition to actuating the two change-over switches 15 and 17, additionally be used to generate an error message 19 or a servicing request.

Thus, the illustrated hearing aid can automatically detect if one of the microphone signals fails and switch the signal processing into emergency operation. Herein, the emergency operation consists of only one microphone signal being processed to maintain the sound quality, like in the case of a hearing aid which innately only has one microphone signal available. According to the general idea of the invention, signal algorithms requiring two or more microphone signals are either deactivated or, where possible, replaced by the single channel pendant thereof (e.g. a dual microphone noise reduction algorithm (DMG) is replaced by the single microphone noise reduction algorithm (SMG)).

The automatic detection of a signal failure in one of the microphones can be implemented by level meters integrated in the hearing aid. If, during comparison, one of the two signal levels is, on average, significantly less than, for example, a statistical stored or dynamically formed reference value, the signal has failed. If this case occurs, the corresponding hearing aid algorithms should be sensibly switched over or cross-faded by an additional control variable and should not remain in an undefined state. Thus, for example, the directional microphone can be explicitly set into the "omni-mode", the corresponding feedback path can be switched off for simplification or—as mentioned above—the two-channel DMG can be replaced by the simplified SMG approach. Replacement algorithms are preferably activated in this case which differ as little as possible from actual algorithms in terms of perception, e.g. microphone frequency paths which are equalized in respect of one another. In this case, in one embodiment a corresponding error detection should be stored, preferably with a time stamp, such that, at the next visit, the audiologist can rectify the error and is also informed as to when the error occurred. Alternatively, algorithms could also be used which are specifically not matched to one another and which give the hearing aid wearer an indication in respect of the malfunction. Support can possibly again be effected by an explicit warning signal.

In addition to the level comparison and the level monitoring, fault characteristics of microphones (e.g. crackling caused by a loose connection) could also be detected in order to be able to diagnose a broader range. Rather than comparing levels, this lends itself to storing a reference curve for the microphones in the hearing aid in order to then monitor the microphone properties at every restart or at a defined time (e.g. after a program switch) by either using a long-term spectrum over an arbitrary microphone signal or by using the spectral distribution of a certain known signal which is stored in the hearing aid and is preferably played automatically (e.g. switching-on melody) or as a result of a user request (e.g. program switch confirmation signal) during normal operation and rerecorded by the microphones. As an alternative to using the direct spectrum, the curves could additionally be weighted according to dBA or loudness so that they only act if the hearing aid wearer would perceptively notice a change.

The acknowledgement to the hearing aid wearer in respect of such an emergency operation can be signaled optically by an LED on the hearing aid or on (preferably wirelessly) connected peripheral equipment by an optical text report on peripheral equipment and/or acoustically by a corresponding warning message by tones (e.g. by playing a different welcome melody when the hearing aid is switched on in the case of recurrence) or by a text message.

A particular advantage of the invention lies in the continuous monitoring and evaluation of the microphone signals so as to then switch into a single microphone emergency program during operation if required. This can systematically eliminate signal distortions which would otherwise be generated as a result of faulty operation of the two-channel algorithms. Abrupt failure becomes less likely and permits the continued use of the hearing aid until an audiologist can be visited. The hearing aid independently files a service request based on incidents.

The invention claimed is:

1. A hearing device, comprising:

a plurality of microphones;

a decision unit connected to said microphones for deciding whether one of said microphones is defective; and a signal processing unit connected to said microphones for processing microphone signals from said microphones using a plurality of processing algorithms, said signal processing unit automatically switches from a first one of the processing algorithms to a second one of the processing algorithms if a decision is made in said decision unit that one of said microphones is defective;

wherein a spectral reference curve for at least one of said microphones for making a decision in respect of a defect is stored in said decision unit.

2. The hearing device according to claim 1, wherein the first signal processing algorithm is a multichannel processing algorithm and the second signal processing algorithm is a single-channel processing algorithm, and said signal processing unit switches from the multichannel processing algorithm to the single-channel processing algorithm if one of said microphones is defective.

3. The hearing device according to claim 2, wherein said signal processing unit is configured for deactivating the multichannel processing algorithm if one of said microphones is defective.

4. The hearing device according to claim 1, wherein said decision unit has a level meter which measures levels of the microphone signals and a prediction analysis can be carried out by said decision unit, in which the microphone signal from one of said microphones can be predicted on a basis of the microphone signal from another one of said microphones to derive a decision from a deviation of a predicted signal from a predetermined signal and measured levels.

5. The hearing device according to claim 1, wherein one of the processing algorithms implements a directional microphone mode and another of the processing algorithms implements an omnidirectional mode, and said decision unit switches into the omnidirectional mode if one of said microphones is defective.

6. The hearing device according to claim 1, further comprising a storage unit by means of which a decision of said decision unit can be logged together with time information.

7. The hearing device according to claim 1, wherein the second processing algorithm, to which a switch is made starting from the first processing algorithm if one of said microphones is defective, is explicitly not matched to the first processing algorithm.

8. The hearing device according to claim 7, wherein said signal processing unit can automatically generate a warning signal to warn a user when the processing algorithms are switched automatically.

9. The hearing device according to claim 1, wherein a loudness of a sound signal recorded by at least one of said microphones is used as a basis for the decision by said decision unit.

10. The hearing device according to claim 1, wherein said decision unit is configured such that a performance state of said microphones can be determined both during operation of the hearing device and in a charge mode in which a battery of the hearing device is being charged.

* * * * *